US006351080B1

(12) United States Patent
Birk et al.

(10) Patent No.: US 6,351,080 B1
(45) Date of Patent: Feb. 26, 2002

(54) CIRCUITRY FOR DIMMING A FLUORESCENT LAMP

(75) Inventors: Berthold Birk, Aschaffenburg; Günter Hahlganss, Kriftel; Walter Kares, Frankfurt; Ulrich Roskoni, Wöllstadt, all of (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/402,619

(22) PCT Filed: Apr. 17, 1998

(86) PCT No.: PCT/EP98/02290

§ 371 Date: Jan. 19, 2000

§ 102(e) Date: Jan. 19, 2000

(87) PCT Pub. No.: WO98/48597

PCT Pub. Date: Oct. 29, 1998

(30) Foreign Application Priority Data

Apr. 24, 1997 (DE) ..... 197 17 309
Aug. 6, 1997 (DE) ..... 197 33 939

(51) Int. Cl.[7] ..... H05B 37/02

(52) U.S. Cl. ..... 315/224; 315/276; 315/307; 315/DIG. 4

(58) Field of Search ..... 315/DIG. 4, 291, 315/307, 224, 276

(56) References Cited

U.S. PATENT DOCUMENTS 4,358,716 A 11/1982 Cordes et al.
5,105,127 A 4/1992 Lavaud et al.
5,920,155 A * 7/1999 Kanda et al. ..... 315/307

FOREIGN PATENT DOCUMENTS

| | | |
|---|---|---|
| DE | 4326415 | 2/1995 |
| DE | 4437204 | 3/1996 |
| EP | 0477922 | 4/1992 |
| EP | 0572207 | 12/1993 |
| EP | 0673184 | 9/1995 |
| GB | 2179510 | 3/1987 |
| WO | 9703541 | 1/1997 |

OTHER PUBLICATIONS

Patent Abstracts of Japan, vol. 015, No., 308 (E–1097) Aug. 7, 1991, & JP 03 112096 A (Matsushita Electric Works Ltd: Others: 01) May 13, 1991.

Patent Abstracts of Japan, vol. 098, No., 001, Jan. 30, 1998, & JP 09 245976 A (Mitsubishi Electric Corp), Sep. 19, 1997.

Patent Abstracts of Japan, vol. 095, No. 003, Apr. 28, 1995 & JP 06 333695 A (Sharp Corp), Dec. 2, 1994.

* cited by examiner

*Primary Examiner*—David Vu
(74) *Attorney, Agent, or Firm*—Martin A. Farber

(57) ABSTRACT

In a circuit arrangement for the dimmable operation of a fluorescent lamp at the operating frequency (f1), having an apparatus for switching the operating frequency (f1) on and off at a dimming frequency (f2), the pulse width (W2) of the dimming frequency (f2) being variable, and where f2<f1, it is provided that the fluorescent lamp current is simultaneously adjustable by the apparatus by the supply voltage being switched on and off at a switching frequency (f3) with a variable pulse width (W3), where f3>f1.

24 Claims, 5 Drawing Sheets

CIRCUITRY FOR DIMMING A FLUORESCENT LAMP

FIELD AND BACKGROUND OF THE INVENTION

The invention relates to a circuit arrangement for the dimmable operation of a fluorescent lamp, in particular for use in motor vehicles as instrument lighting. The prior art discloses corresponding circuit arrangements in which the fluorescent lamp is operated at an operating frequency. The effect achieved by the switching-on and -off of the operating frequency with an apparatus and thus the lamp at a dimming frequency which lies above the visual frequency of the human eye, is that the human eye is given the impression that the fluorescent lamp has a different brightness, depending on the pulse width of the dimming frequency. In order to adjust the lamp current through the fluorescent lamp, it is necessary either to provide an additional regulator or to use a resonant circuit which is stabilized in a complicated manner. The object of the invention, therefore, is to specify a circuit arrangement for dimming a fluorescent lamp which is constructed in a simple manner.

SUMMARY OF THE INVENTION

This object is achieved by virtue of the fact that by means of the apparatus which switches the operating frequency on and off at the dimming frequency, the supply voltage can simultaneously be switched on and off at a switching frequency and the lamp current is thereby adjustable, the switching frequency being greater than the operating frequency.

As a result of the refinement of the circuit with a push-pull converter for generating the operating frequency, a simply constructed functional realization of oscillator and regulator is achieved.

A push-pull converter constructed in a particularly simple manner is realized by a resonant circuit comprising a capacitance element and an inductance element, said resonance circuit being connected to a first pole of the supply voltage. Furthermore, the resonance circuit can be alternately connected via two switches directly or via a third switch to the second pole of the supply voltage. In this case, the two switches are connected by a respective terminal to the terminals of the capacitance element and/or of the inductance element. In this circuit, the fluorescent lamp may either be arranged in parallel with the inductance element and/or capacitance element or be supplied with the operating frequency via a transformer, the primary winding of the transformer advantageously forming the inductance element of the resonant circuit.

The use of electronic switches such as e.g. transistors or field-effect transistors constitutes a cost-effective solution for the switches.

A circuit arrangement with few components is realized by a circuit arrangement as claimed in claim 5.

The circuit arrangement as claimed in claim 6 specifies a particularly effective arrangement for regulating the lamp current which is nevertheless constructed in a simple manner and with few components.

The positive feedback device in the form of a coil applied to the same coil former as the inductance element can be produced in a simple manner and at the same time as the inductance element.

By virtue of the fact that the lamp-current desired value is predetermined as a function of the temperature of the fluorescent lamp or of the surroundings, a minimum brightness is achieved even at low temperatures.

Circuit arrangements according to the invention which are constructed in a particularly simple manner are specified in claims 9 and 12. The circuit can be realized with a low outlay on components particularly when a microprocessor is used for the control device, which microprocessor may even already be present for other tasks, for example in a combination instrument of a motor vehicle, and the brightness control according to the invention is used for the instrument lighting. Of course, the circuit can also be realized with a separate microprocessor or by means of switching gates.

A circuit arrangement in which the operating frequency of the fluorescent lamp approximately corresponds to the resonant frequency of the resonant circuit results in a virtually sinusoidal operating frequency with few harmonics. This reduces interference that may issue from the circuit, and thus increases the electromagnetic compatibility of the circuit.

As a result of the two switches being simultaneously switched on and subsequently off b before or at the beginning of the pulse train intermission, the current contained in the resonant circuit can be short-circuited and persistence of the fluorescent lamp can thus be reliably prevented. Inserting a series inductor between one pole of the supply voltage and the resonant circuit makes it possible for the current through the circuit to be additionally stabilized and kept sinusoidal.

BRIEF DESCRIPTION OF THE DRAWINGS

The invention is described in more detail below with reference to the figures of the drawings for three possible embodiments. In the figures

BRIEF DESCRIPTION OF THE PREFERRED EMBODIMENT

Figure 1:
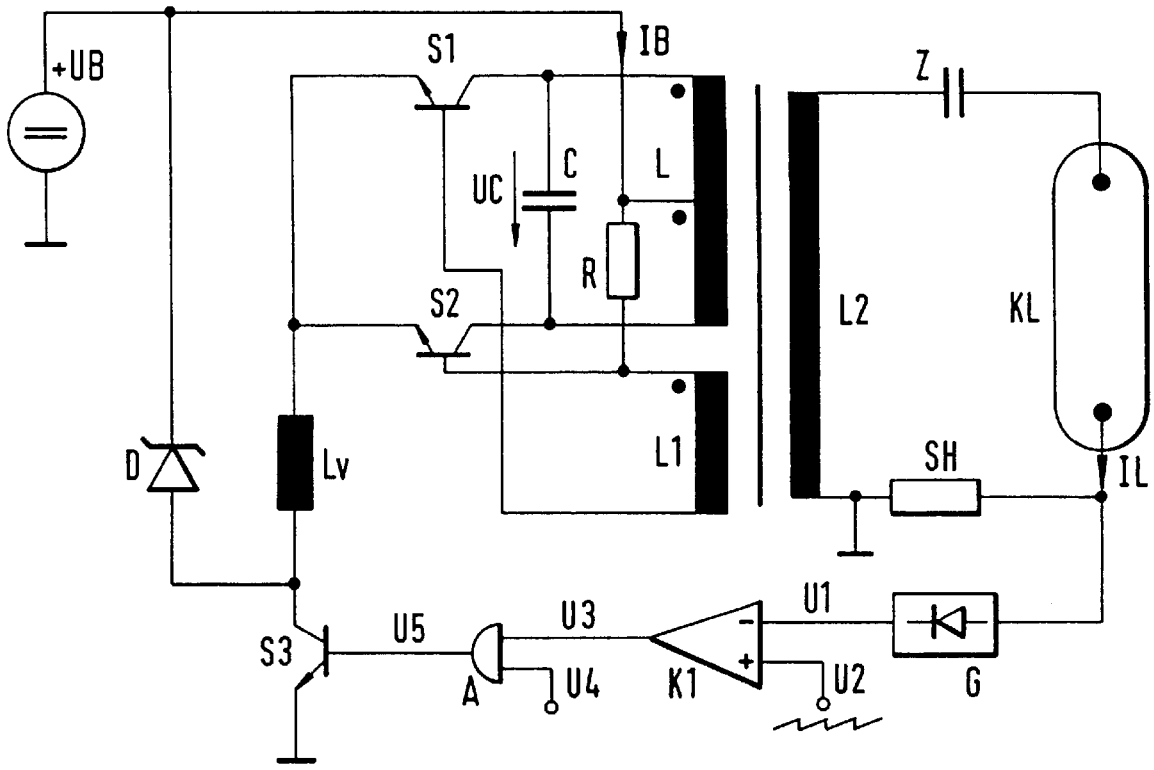
FIG. 1 shows a first circuit with a push-pull converter.

The push-pull converter from FIG. 1 has a resonant circuit comprising the capacitor C and the coil L, which resonant circuit is connected directly to the positive supply voltage and can be alternately connected via the transistors S1, S2 to the ground potential via the series inductor Lv and the transistor S3. The description below assumes that the transistor S3 is switched on, and that is to say that the transistors S1, S2 are connected to the second pole of the supply voltage. The voltage is fed back positively by the coil L1, which is wound on the same coil former as the coil L, and the AC voltage that occurs alternately turns the transistors S1, S2 off at the oscillation frequency of the resonant circuit. The operating point of the two transistors S1, S2 is set by way of the resistor R. The resonant circuit oscillates at its resonant frequency $\omega=1:\sqrt{L\times C}$, where L represents the inductance of the coil and C the capacitance of the capacitor C. The resonant circuit transfers its energy via the transformer, which is formed from the coils L, L1 and L2, to the lamp circuit, which also has the fluorescent lamp KL, the impedance Z and a shunt SH in addition to the coil L2.

Figure 2:
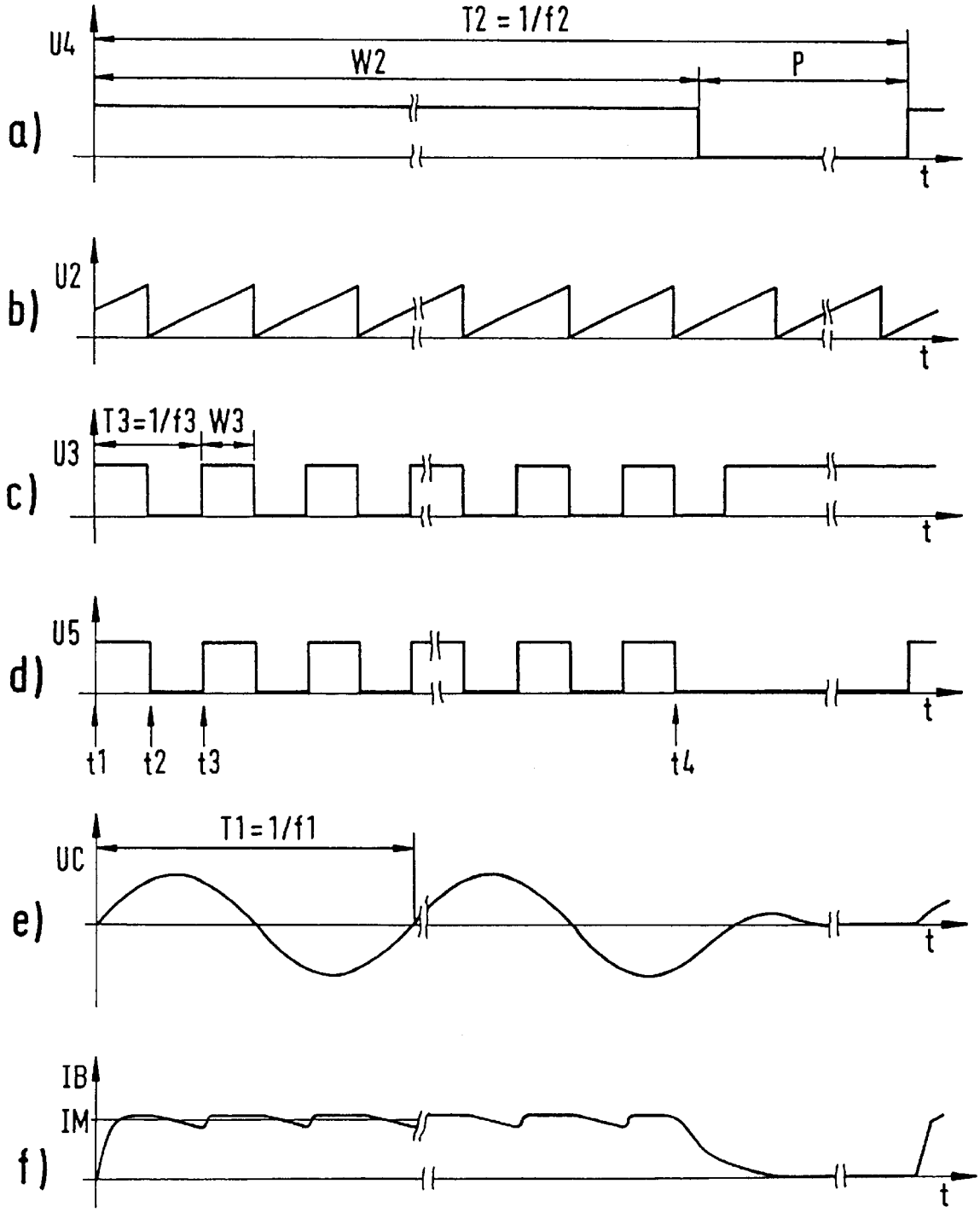
FIG. 2 shows individual profiles of state variables of the circuit from FIG. 1.

The voltage is tapped off between the fluorescent lamp KL and the shunt SH and sent to the rectifier G. The rectified voltage U1 is applied to the inverting input the comparator K. A sawtooth-waveform voltage U2 at the frequency f3=1:T3, the profile of which is illustrated in FIG. 2*b*, is applied to the positive input of the comparator. Depending on the lamp current IL and the voltage consequently established across the shunt SH, the pulse width W3 of the square-wave voltage U3 at the frequency f3 present at the output of the comparator K1 is altered.

The higher the lamp current is, the shorter the pulse width W3 of the square-wave voltage becomes. In FIG. 2*c*, the switched-on and -off duration of the pulses illustrated is identical.

If the lamp current IL becomes larger, pulse width W3 becomes shorter, and correspondingly longer with a smaller current. The specification of the desired value of the current can be set by the level of the triangular-waveform voltage in FIG. 2*b*. The output voltage U3 of the comparator K1 is passed to an input of the AND element A, while the dimming frequency f2 with the voltage profile U4 is applied to the second input of the AND element A (FIG. 2*a*). The dimming frequency f2 has a rectangular waveform and its pulse width W2 is likewise variable. The pulse width W2 of the dimming frequency f2 determines the switched-on duration of the push-pull converter and thus of the fluorescent lamp KL, as will be described in even more detail below. The pulse width W2 of the dimming frequency f2 is adjustable e.g. either automatically as a function of the ambient brightness or manually depending on the desired brightness of the fluorescent lamp KL.

The voltage U5 is present at the output of the AND element A: said voltage has switching pulses having the pulse width W3 at the switching frequency f3 during the pulse width W2 of the dimming frequency f2. Consequently, the transistor S3 is turned on during the switching pulses with the pulse width W3. The transistor S3 is switched on by the first pulse with the pulse width W3 during a pulse width W2 of the dimming frequency f2. During this time, the current IB can flow from the supply voltage source+UB into the resonant circuit. The resonant circuit begins to oscillate at its resonance frequency. When the transistor S3 turns off after the first pulse having the pulse width W3 at the instant t2, the resonant circuit continues to oscillate and the current stored in the resonant circuit flows back into the resonant circuit through the series inductor Lv and the diode D, connected as a freewheeling diode, but decreases correspondingly.

With the next switching pulse having the pulse width W3 at the instant t3, the transistor S3 switches on again: current can again flow from the supply voltage source+UB into the resonant circuit and the current IB increases during the switched-on duration.

The current thus fluctuates about its mean value IM (FIG. 2*f*) during the pulse width W2 of the dimming frequency f2. With an increasing or decreasing pulse width W3, the current IB is correspondingly increased or decreased, respectively, and the lamp current IL correspondingly via the transformer. If the pulse width W2 of the dimming frequency f2 has ended and the last pulse of the pulse train having the frequency f3 has been applied to the transistor S3 at the instant t4, the transistor S3 is turned off during the intermission time P of the frequency f2. The oscillation of the resonant circuit decays on account of said circuit's loading by the lamp KL and inherent losses, the currents IB and IL become 0 again and the fluorescent lamp extinguishes. With the beginning of the next pulse at the dimming frequency f2, it begins to illuminate again as described above. Since the dimming frequency f2 lies above the human visual frequency, to the human eye the fluorescent lamp appears to have different brightnesses, depending on the pulse width W2.

Given a sufficiently large supply voltage, the fluorescent lamp KL can also be arranged in the primary circuit e.g. in parallel with the capacitor C, it thereby being possible to dispense with the secondary coil L2. Furthermore, the voltage for the rectifier G can also be tapped off via a shunt in the primary circuit.

Figure 3:
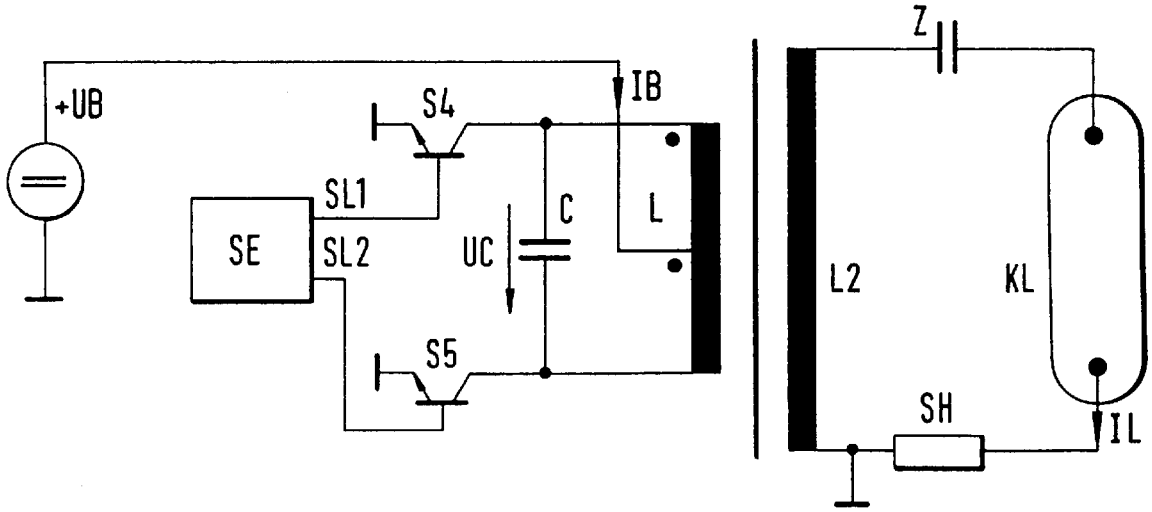
FIG. 3 shows a second circuit with a push-pull converter.

The circuit from FIG. 3 likewise has a resonant circuit comprising the capacitor C and the coil L, which circuit is connected to the positive supply voltage and can be alternately connected to the ground potential via the transistors S4, S5. The control device SE is connected to the base of the transistors S4, S5 via a respective control line SL1, SL2.

Via the control lines SL1, SL2, the transistors S4, S5 are alternately driven with the pulse trains at the switching frequency f3 during the pulse width W2 of the dimming frequency f2 (FIG. 4*a*), the duration T5 of the individual consecutive pulses for a transistor S4, S5 amounting to half the oscillation duration T1 of the resonant circuit (FIGS. 4*b*, *c*). The resonant circuit thus has the frequency f1=1:T1 impressed on it (FIG. 4*d*).

Provided that the frequency f1 is equal to the resonant frequency of the resonant circuit, the resonant circuit oscillates virtually sinusoidally, with the result that only small interfering harmonics occur. Therefore, it is likewise advantageous if the oscillation duration T of the resonant frequency is an even multiple of the oscillation duration T3 of the switching frequency f3.

Figure 4:
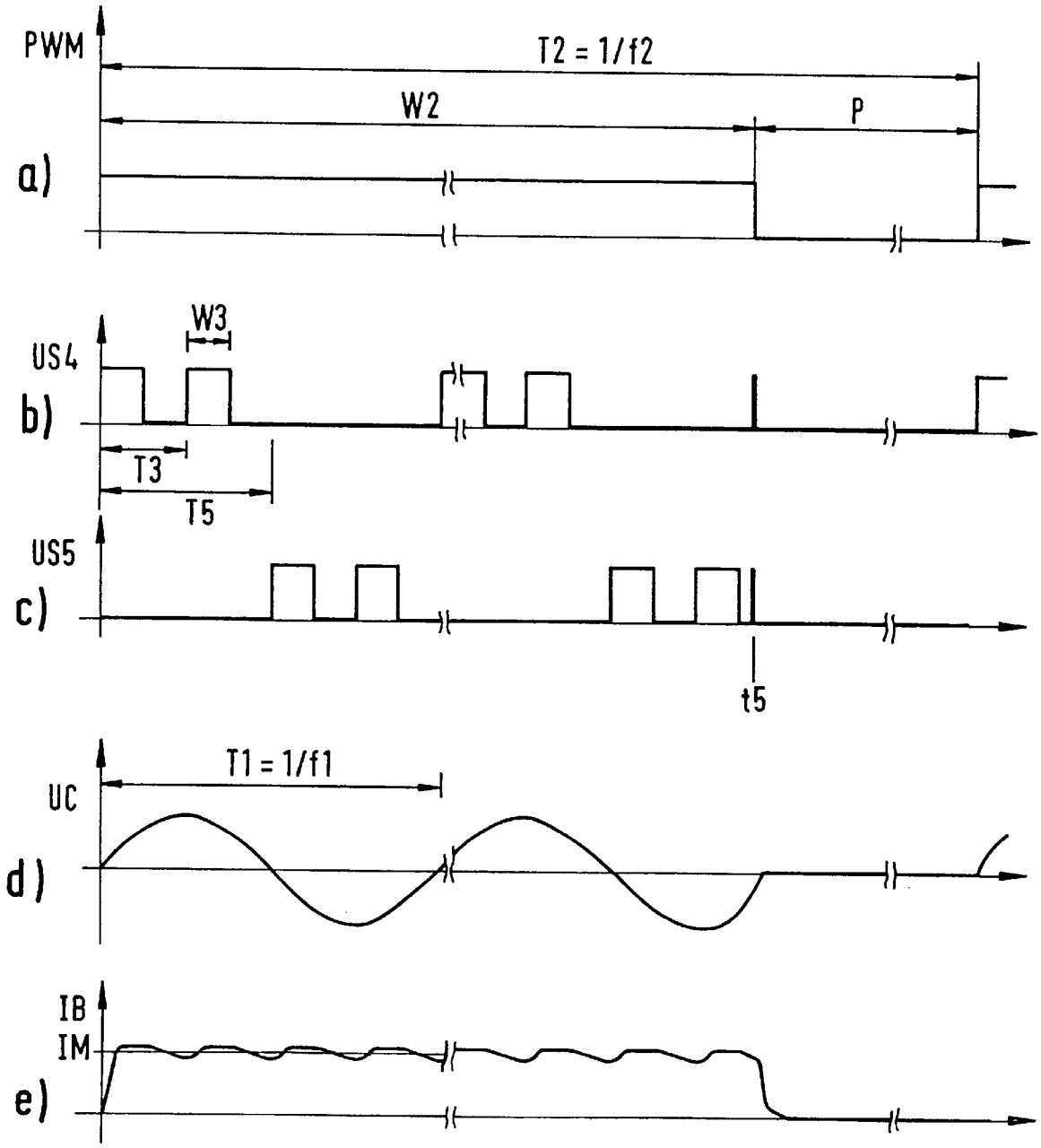
FIG. 4 shows individual profiles of state variables of the circuit from FIG. 3.

In FIG. 4, the oscillation duration T1 of the resonant circuit corresponds to four times the oscillation duration T3 of the individual pulses. The mean current IM in the primary circuit and thus also the lamp current IL in the secondary circuit are set by means of the pulse width W3 of the individual pulses.

Provided that the two transistors S4, S5 are turned on simultaneously at the end of the dimming pulse at the instant t5 (FIG. 2*b*, *c*), the current present in the resonant circuit is short-circuited, with the result that it decreases rapidly to a zero point and the fluorescent lamp KL thus switches off without uncontrolled persistence.

The dimming frequency f2 is present internally only in the control device SE. Its pulse width W2 determines the switched-on duration of the resonant circuit and thus the switched-on duration of the fluorescent lamp KL. The circuit illustrated in FIG. 3 corresponds to an open-loop controller. For this purpose, it is possible to store individual pulse width values W2 of the dimming frequency f2 for different desired brightnesses and/or operating temperatures in the storage devices which are present directly in the control device SE or can be accessed by the control device SE.

It is also possible to construct a closed-loop controller e.g. by measuring the currents IB or IL and correspondingly correcting the lamp current.

Figure 5:
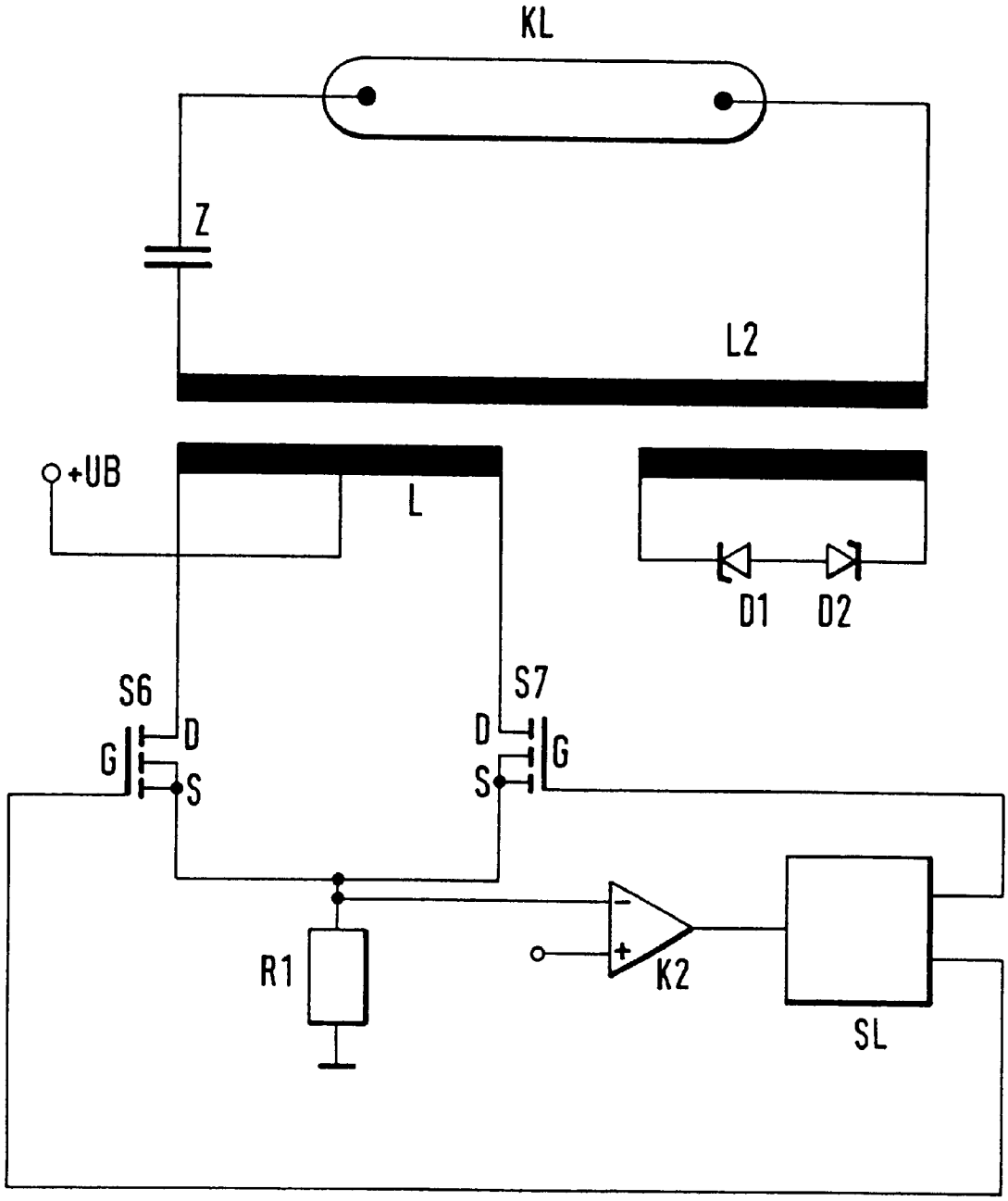
FIG. 5 shows a third circuit with a push-pull converter, and FIG. 6 composed of FIGS. 6*a* and 6*b*, shows individual profiles of the state variables of the circuit from FIG. 5.

FIG. 5 shows a fluorescent lamp KL connected to the secondary circuit L2 of a transformer via a high-voltage capacitor Z. The transformer is energized in its primary circuit L by two MOSFET transistors S6 and S7 which switch in a push-pull manner and are driven by a control device SL, the primary circuit L of the transformer simultaneously being connected to the operating voltage $U_B$. In this case, each gate G of the transistors S6, S7 is connected to the control device SL. The drain D of each transistor S6, S7 leads to the primary winding L of the transformer, the sources S of the MOSFET transistors S6, S7 jointly leading to a grounded shunt resistor R1.

The control device SL processes a voltage drop across the shunt resistor R1 as input signal. The voltage drop is fed to the inverting input of a comparator K, to whose non-inverting input a reference voltage $U_{REF}$ with a constant value is applied. The output of the comparator K is connected to the control device SL.

The function of the driving of the cold-cathode fluorescent lamp KL is explained below with reference to FIGS. 6*a* and *b*. In this case, the following are plotted against time Signal 1 Drive signal at the MOSFET transistor S6

Signal 2 Drive signal at the MOSFET transistor S7

Signal 3 Current through the cold-cathode fluorescent lamp KL

Signal 4 Voltage across the cold-cathode fluorescent lamp KL

The two MOSFET transistors S6, S7 are successively driven once with a pulse 1 in each case. The resonant circuit, comprising the secondary coil L2, the high-voltage capacitor Z and the fluorescent lamp KL, is consequently activated. The resonant circuit decays exponentially (cf. signal 4, point 2). The gas in the cold-cathode fluorescent lamp KL may be ionized and organized in this time. A specific time after the initial activation of the resonant circuit, for example after 80 usec, the transistors S6, S7 are continuously driven reciprocally (signals 1 and 2, point 4). Starting from this point in time, the cold-cathode fluorescent lamp KL immediately emits light (as can be inferred from signal 4 at point 3).

Figure 6A:
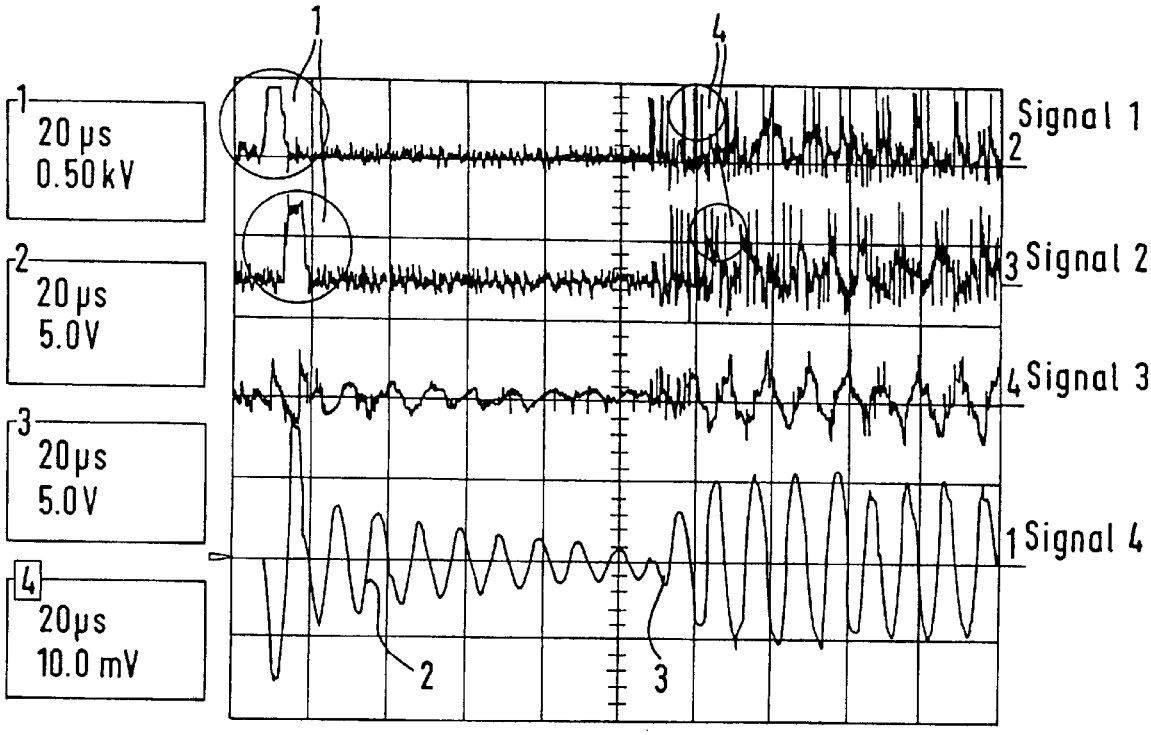

The control device SL drives the MOSFET transistors S6, S7 in a pulsed manner (FIG. 6*a,* signals 1 and 2). The current flowing through the MOSFET transistors S6, S7 is measured as a voltage drop across the shunt resistor R1 and evaluated by the comparator K2, which outputs a low or high signal depending on whether or not the measured voltage exceeds the reference value. The output signal of the comparator K2 is logically combined with the signal 1 in the control device SL. The result of this is that the MOSFET transistors S6, S7 are turned on or turned off during the driving by the control logic unit in time with the output signal of the comparator K.

Figure 6B:
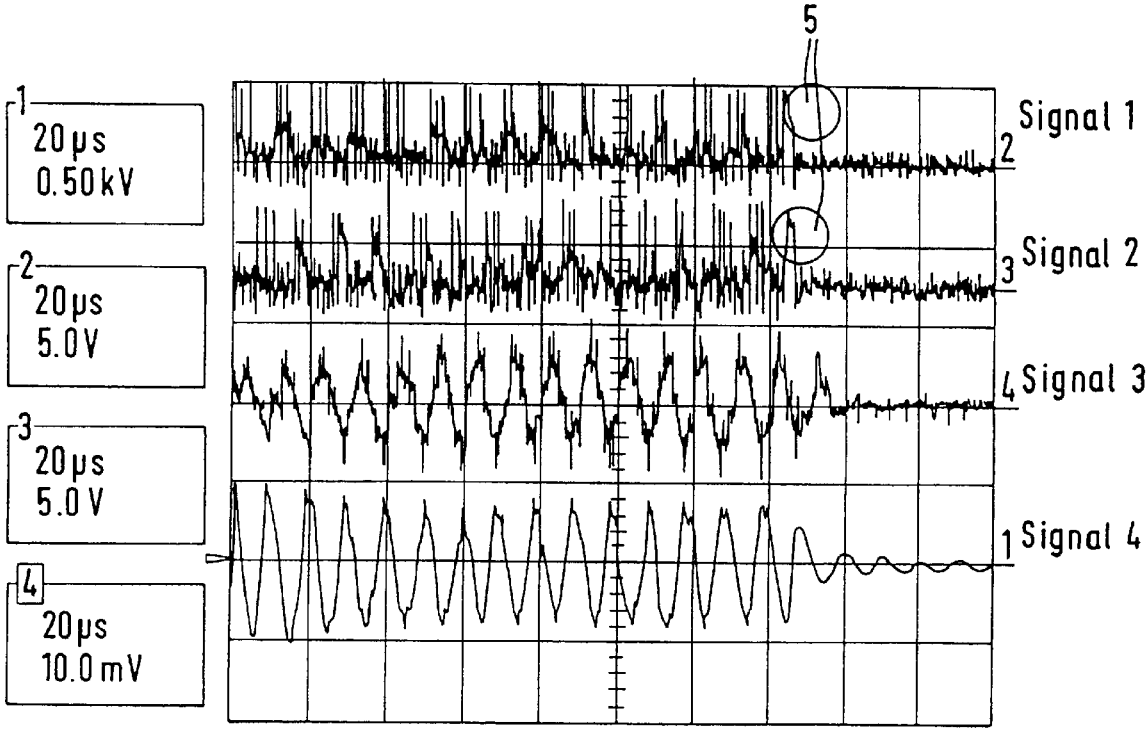

After the desired number of drive pulses, the two MOSFET transistors S6, S7 are driven simultaneously, as revealed in FIG. 6*b,* signals 1 and 2 at the instant 5. As a result of this, the energy is abruptly drawn from the resonant circuit L2, Z, KL and the light emission of the cold-cathode fluorescent lamp terminates immediately.

This apparatus has the advantage that the flicker-free operation of the fluorescent lamp L is achieved just by the special driving of the MOSFET transistors S6, S7. Extensive control circuits of the kind that are otherwise customary can be dispensed with.

We claim:

1. A circuit for the dimming of a fluorescent lamp which operates at a specific operating frequency (f1), comprising:

an apparatus for switching the fluorescent operation on and off in a pulsed dimming pattern at a dimming frequency (f2), a pulse width (W2) of the pulsed dimming pattern being variable, and the dimming frequency (f2) being less than the operating frequency (f1); and a pulse-width modulator for adjusting a fluorescent lamp current by switching a supply voltage on and off at a switching frequency (f3) with a variable pulse width (W3), the switching frequency (f3) being greater than the operating frequency (f1).

2. The circuit as claimed in claim 1, further comprising a push-pull converter for energizing the lamp at the operating frequency (f1).

3. The circuit as claimed in claim 2, further comprising a first switch and a second switch, wherein the push-pull converter has a resonant circuit with a capacitance element and an inductance element (L);

wherein the resonant circuit is connected to a first pole of a supply voltage source of the supply voltage;

wherein the resonant circuit is connected alternately via the first and the second switches (S1, S2, S4, S5), which are each connected between a terminal of the inductance element (L) and/or of the capacitance element (C), and a second pole of the supply voltage source directly or via a third switch (S3);

wherein respective ones of the first and the second switches (S1, S2, S4, S5) are connected to respective terminals of the inductance element (L) and/or of the capacitance element (C);

wherein the fluorescent lamp (KL) is arranged in parallel with the inductance element (L) and capacitance element (C) or is supplied with electric power at the operating frequency (f1) via a transformer, a primary winding of the transformer forming the inductance element (L) of the resonant circuit.

4. The circuit as claimed in claim 3, wherein the switches (S1, S2, S3, S4, S5) are electronic switches.

5. The circuit as claimed in claim 3, wherein the first and second switches (S1, S2) are connected via the third switch (S3) to the second pole of the supply voltage source;

wherein the third switch (S3) is connected to the first pole of the supply voltage source via a current valve (D);

wherein the current valve (D) serves as a freewheeling diode when the third switch is not in the on state;

wherein control terminals of the first and the second switches (S1, S2) are connected to a positive feedback device; and wherein the third switch is actuated by pulse trains in which individual pulses have a switching period (T3= 1:f3) and are enabled for the duration of the pulse widths (W2) of the pulsed dimming pattern.

6. The circuit as claimed in claim 5, further comprising an AND element and a comparator, wherein the output of the AND element (A) is connected to a control terminal of the third switch, a signal with the pulsed dimming pattern is applied to one input of the AND element and, to the other input of which AND element, there is applied an output of the comparator (K); and a sawtooth- or triangular-waveform signal at the switching frequency (f3) is applied to a positive input terminal of the comparator and to a negative input terminal of which comparator there is applied a signal which corresponds to the actual or assumed lamp current (IL) or to a primary current (IB) of the supply voltage source.

7. The circuit as claimed in claim 5, wherein the positive feedback device comprises a coil (L1), which is wound onto the same coil body as the inductance element (L) and whose respective terminals are connected to the control terminals of the first and the second switches (S1, S2), respectively.

8. The circuit as claimed in claim 3, further comprising a control device, wherein the first and the second switches (S4, S5) are connected to a second pole of the supply voltage source, wherein the first and second switches (S4, S5) are connected by their respective control terminals to the control device (SE), wherein the control device (SE) alternately drives the switches (S4, S5) with pulse trains whose individual pulses have the switching period (T3), and the duration (T5) of the individual consecutive pulses for one of the switches (S4, S5) amounting to half the oscillation duration (T1) of the resonant circuit.

9. The circuit as claimed in claim 8, wherein the switching frequency (f3) is an even multiple of the operating frequency (f1).

10. The circuit as claimed in claim 8, wherein the operating frequency (f1) approximately corresponds to a resonant frequency of the resonant circuit.

11. The circuit as claimed in one of claim 8, wherein, before or at the beginning of a pulse train intermission, the control device (SE, SL) simultaneously switches the first and the second switches (S4, S5, S6, S7) on and then off again.

12. The circuit as claimed in claim 8, wherein the control device (SE) regulates the pulse widths (W3) of the supply voltage switching frequency (f3) as a function of the lamp current.

13. The circuit as claimed in claim 8, wherein the control device (SE) controls the pulse widths (W3) of the supply voltage switching frequency (f3) on the basis of a temperature of the lamp or of the surroundings.

14. The circuit as claimed in claim 8, wherein the control device controls the pulse width (W2) of the pulsed dimming pattern frequency (f2) as a function of the ambient brightness or a desired value transmitter.

15. The circuit as claimed in claim 8, wherein a series inductor (Lv) is arranged between one pole of the supply voltage source and the resonant circuit.

16. The circuit as claimed in claim 1, wherein the lamp-current desired value (IL) is predetermined as a function of the temperature of the fluorescent lamp or of the surroundings.

17. A circuit for the dimming of a fluorescent lamp which operates at a specific operating frequency (f1), comprising:

an apparatus for switching the fluorescent operation on and off in a pulsed dimming pattern at a dimming frequency (f2), a pulse width (W2) of the pulsed dimming pattern being variable, and the dimming frequency (f2) being less than the operating frequency (f1); and a pulse-width modulator for adjusting a fluorescent lamp current by switching a supply voltage on and off at a switching frequency (f3) with a variable pulse width (W3), the switching frequency (f3) being greater than the operating frequency (f1); further comprising two power switches, a control device and a shunt resistor, wherein the two power switches (S6, S7) are arranged in the primary circuit of a transformer, and are driven in a push-pull manner by the control device (SL), wherein the shunt resistor (R1) connects respective terminals of the switches (S6, S7) to ground, and wherein a voltage drop across the resistor is used for current regulation.

18. The circuit as claimed in claim 17, further comprising a comparator, wherein the voltage drop is passed via the comparator (K2) to the control device (SL), the voltage drop being applied to a first input of the comparator (K2), wherein a reference voltage is passed to a second input terminal of the comparator.

19. The circuit as claimed in claim 17, wherein the switches (S6, S7) are MOSFET transistors whose drains (D) are connected to a primary circuit (L) of the transformer and whose gates (G) are connected to the control device (SL), sources (S) of the two transistors (S6, S7) being connected both to the shunt resistor (R1) and to the comparator (K2).

20. The circuit arrangement as claimed in claim 17, wherein, before or at the beginning of the pulse train intermission, the control device (SE, SL) simultaneously switches the first and the second switches (S4, S5, S6, S7) on and then off again.

21. The circuit as claimed in claim 20, wherein the control device (SE) regulates the pulse widths (W3) of the supply voltage switching at the frequency (f3) as a function of the lamp current.

22. The circuit as claimed in claim 20, wherein the control device (SE) controls the pulse widths (W3) of the supply-voltage switching at the frequency (f3) on a basis of the temperature of the lamp or of the surroundings.

23. The circuit as claimed in claim 20, wherein the control device controls the pulse width (W2) of the pulsed dimming pattern at the frequency (f2) as a function of the ambient brightness or a desired value transmitter.

24. The circuit as claimed in claim 20, wherein a series inductor (Lv) is arranged between one pole of a supply voltage source of the supply voltage and a resonant circuit.

* * * * *